US006494685B2

(12) United States Patent
Carstensen

(10) Patent No.: US 6,494,685 B2
(45) Date of Patent: Dec. 17, 2002

(54) PUMP AND MOTOR ASSEMBLY WITH CONSTANT PRESSURE OUTPUT

(75) Inventor: Peter T. Carstensen, Adirondack, NY (US)

(73) Assignee: Kadant, Inc., Acton, MA (US)

( * ) Notice: Subject to any disclaimer, the term of this patent is extended or adjusted under 35 U.S.C. 154(b) by 0 days.

(21) Appl. No.: 09/821,603

(22) Filed: Mar. 29, 2001

(65) Prior Publication Data

US 2002/0141875 A1 Oct. 3, 2002

(51) Int. Cl.[7] ..... F04B 49/06
(52) U.S. Cl. ..... 417/44.1; 417/45; 417/53
(58) Field of Search ..... 417/44.1, 45, 53

(56) References Cited

U.S. PATENT DOCUMENTS 3,847,507 A * 11/1974 Sakiyama et al. ..... 417/22
3,985,467 A * 10/1976 Lefferson ..... 417/20
4,449,079 A * 5/1984 Erdman ..... 318/138
4,726,738 A 2/1988 Nakamura et al.
4,868,477 A * 9/1989 Anderson et al. ..... 318/685
4,913,624 A * 4/1990 Seki et al. ..... 417/15
4,971,522 A 11/1990 Butlin
5,026,256 A * 6/1991 Kuwabara et al. ..... 417/45
5,141,402 A 8/1992 Bloomquist et al.
5,295,737 A 3/1994 Epple et al.
5,517,931 A 5/1996 Kawaguchi ..... 111/118
5,716,194 A * 2/1998 Butterfield et al. ..... 417/43
5,777,447 A * 7/1998 Okano ..... 318/254
5,947,693 A 9/1999 Yang
5,971,721 A 10/1999 Carstensen
5,980,211 A * 11/1999 Tojo et al. ..... 417/45

* cited by examiner

*Primary Examiner*—Charles G. Freay
*Assistant Examiner*—Timothy P. Solak
(74) *Attorney, Agent, or Firm*—Frommer Lawrence & Haug LLP; Ronald R. Santucci

(57) ABSTRACT

Disclosure is made of a method for electronic polar attenuation of torque profile for positive displacement pumps by a processor where the attenuated torque profile is compared with the shaft displacement angle of the pump input shaft. The processor then signals a motor to power a pump with the result of pumping at a constant pressure at the full range of the designed system flow volume. In addition to the attenuated torque profile, the processor can also account for the response time of the pump drive, the motor inductive reactance, system inertia, application characteristics of the pump, and regenerative energy during deceleration of the pump.

5 Claims, 6 Drawing Sheets

FIG. 4

| "Q" | %torque above mean | % torque below mean | Total variation % |
|---|---|---|---|
| 4:1 | 8.2 | 20.0 | 28.2 |
| 5:1 | 7.6 | 17.6 | 25.2 |
| 6:1 | 6.9 | 16:1 | 23.0 |
| 7:1 | 6.4 | 15.2 | 21.6 |

PUMP AND MOTOR ASSEMBLY WITH CONSTANT PRESSURE OUTPUT

BACKGROUND OF THE INVENTION

1. Field of the Invention

This invention relates to a method of electronically attenuating a polar grid based on the torque profile of a positive displacement pump in order produce a constant pump pressure regardless of pump radial crankshaft/camshaft/crankarm location and the velocity of the fluid being pumped. In the method, an electronic processor compares the shaft displacement angle of the pump input shaft to a reference polar grid of torque profile and varies the electrical power applied to the pump motor. The processor can also take into account the response time of the pump drive, the motor inductive reactance, system inertia, application characteristics of the pump, and regenerative energy during deceleration of the pump.

2. Description of the Prior Art

In the prior art, it is well known that in situations where higher pressures of fluid movement are desired, a positive displacement pump is commonly used. A positive displacement pump is usually a variation of a reciprocating piston and a cylinder, of which the flow is controlled by some sort of valving. Reciprocal machinery, however can be less attractive in use than rotary machinery because the output of a reciprocal machine is cyclic, where the cylinder alternatively pumps or fills, therefore there are breaks in output. This disadvantage can be overcome to a certain extent by: using multiple cylinders; bypassing the pump output through flow accumulators, attenuators, dampers; or waste gating the excess pressure thereby removing the high pressure output of the flow.

In addition to uneven pressure and flow output, reciprocating pumps have the disadvantage of uneven power input proportional to their output. This causes excessive wear and tear on the apparatus, and is inefficient because the pump drive must be sized for the high torque required when the position of the pump connecting rod is at an angular displacement versus crankarm dimension during the compression stroke that would result in the highest required input shaft torque.

Moreover, if the demand of the application varies, complicated bypass, recirculation, or waste gate systems must be used to keep the system from "dead-heading". That is, if flow output is blocked when the pump is in operation, the pump will either breakdown by the increased pressure or stall. If stalling occurs, a conventional induction electric motor will burn out as it assimilates a locked rotor condition with full rated voltage and amperage applied. Typically systems with fixed displacement pumps use a relief valve to control the maximum system pressure when under load. Therefore, the pump delivers full flow at full pressure regardless of the application thus wasting a large amount of power.

In this regard, certain prior art that attempts to correct the problems associated with torque output of a pump motor should be noted.

In U.S. Pat. No. 5,971,721, an eccentric transmission transmits a torque demand from a reciprocating pump, which varies with time, to the drive motor such that the torque demand on the drive motor is substantially constant. The result is the leveling of torque variation required to drive a positive displacement pump at the transmission input shaft with the effect of constant pump output pressure. This is accomplished by means of eccentric pitch circle socket sets with gear belts or eccentric pitch circle matched gear sets.

The use of an eccentric gear or sprocket set, has a significant effect on the overall torque requirement and the magnitude of the discharge pulsation of the pump but because most pumps are of a multi-cylinder or are vane or gear types, the pump input shaft torque requirement would not be perfectly counter-acted (leveled) by using the reduction pattern developed by eccentrically matched transmission components.

In U.S. Pat. No. 5,947,693, a position sensor outputs a signal by sensing the position of a piston in a linear compressor. A controller receives the position signal and sends a control signal to control directional motion output from a linear motor.

In U.S. Pat. No. 4,726,738, eighteen or nineteen torque leads are measured during main shaft in order to maintain constant shaft velocity. revolution and are translated to a required motor torque for particular angles of the main shaft.

U.S. Pat. No. 4,971,522 uses a cyclic lead transducer input and tachometer signal input to a controller to signal varied cyclic motor input controls to provide the required motor torque output. A flywheel is coupled to the motor in order to maintain shaft velocity. However, the speed of the motor is widely varied and the torque is varied to a smaller extent. U.S. Pat. No. 5,141,402 discloses an electrical current and frequency applied to the motor which are varied according to fluid pressure and flow signals from the pump. U.S. Pat. No. 5,295,737 discloses a motor output which is varied by a current regulator according to a predetermined cyclic pressure output requirement. The motor speed is set to be proportional to the volume consumed and inversely proportional to the pressure.

It is seen from the foregoing that there is a need for electronic attenuation of torque profile in a pump. When torque profile is compared with input shaft displacement and other factors such as system inertia, and response time of the pump drive etc., a pump can produce constant pressure at the full range of the designed system volume.

SUMMARY OF THE INVENTION

It is therefore an object of the present invention to provide a method for electronic attenuation of pump torque variation requirements in order to produce a matched motor torque output that will result in constant output pressure from a pump.

It is therefore a still further object of the present invention to provide control factors which vary the power and torque output of a pump motor based on calculated torque variation requirements.

It is therefore a still further object of the present invention to increase the energy efficiency of a pump by providing a force balanced relationship between the motor output and application hydraulic requirement.

It is therefore a still further object of the present invention to decrease the wear and tear on the pump by providing a substantially constant force output from the motor of the pump and reduce the amount of cycles of the pump to the application requirement.

It is therefore a further object of the present invention to provide a method for electronic attenuation of pump torque variation supplying information for design of a transmission system that can achieve a constant force output from the motor to the pump.

To attain the objects described, there is provided a method for obtaining a polar map for process control within the electronic drive of a targeted pump. This polar map is calculated by a processor or externally calculated then input into a processor. Once the torque profile of the pump is obtained and translated into a polar map, the processor can compare the shaft displacement angle of the pump input shaft to the reference polar map. The processor can also take into account selected factors such as the response time of the pump drive, the motor inductive reactance, system inertia, application characteristics of the pump, and regenerative energy during deceleration of the pump. Using selected factors and the comparison results the processor then signals the motor controller to vary the amperage, voltage, and frequency applied to the motor in order to regulate the torque output of the pump motor. With an accurately regulated motor power output, the pump output pressure will remain constant regardless of pump crank arm location or the velocity of fluid flow.

BRIEF DESCRIPTION OF THE DRAWINGS

Thus by the present invention, its objects and advantages will be realized, the description of which should be taken with regard to the accompanying drawings herein.

FIG. 4 is a table depicting variations of input torque above and below the mean for triplex pumps in relation to the linear distance between the plunger/piston pivot point and the throw pivot point multiplied by the throw radius.

DETAILED DESCRIPTION OF THE PREFERRED EMBODIMENTS

Figure 1:
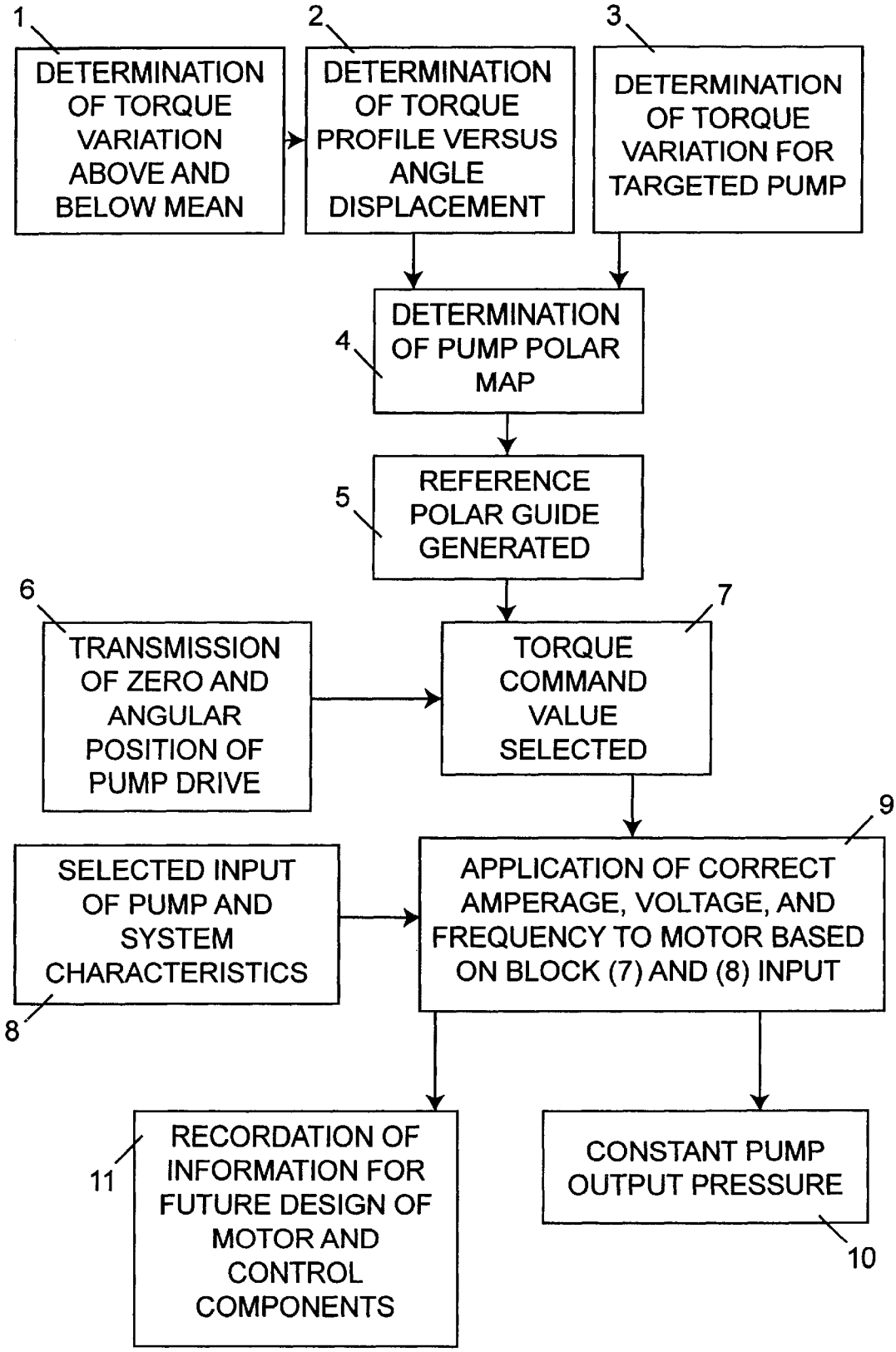
FIG. 1 is a block diagram of the steps required for a method of electronic attenuation of torque profile and the resulting control of the pump.

Referring now to the drawings in detail wherein like numerals refer to like elements throughout the several views where Blocks 1–5 of FIG. 1 depict the development of a baseline polar guide of torque profile for the targeted pump.

Figure 2:
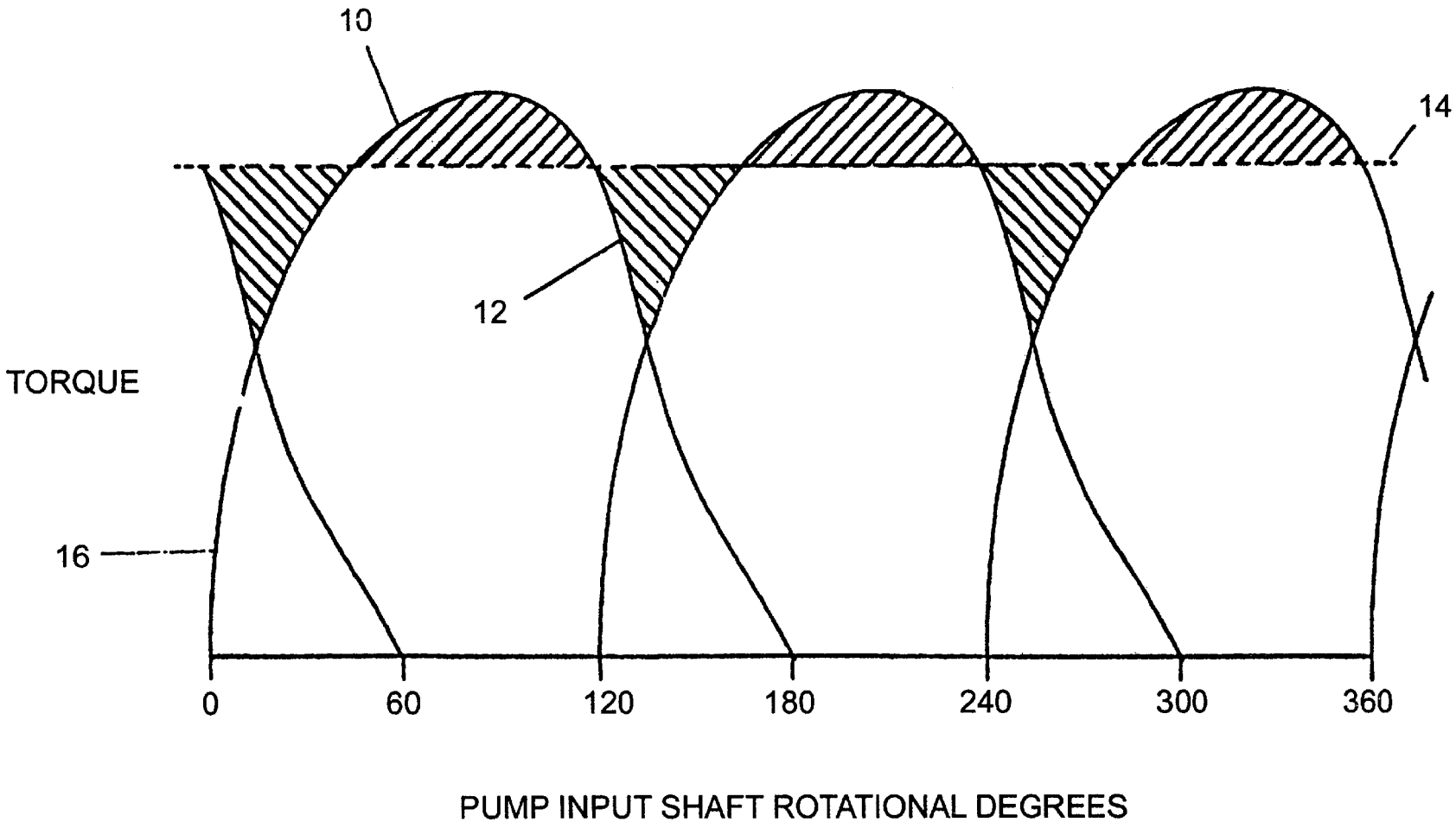
FIG. 2 is a graph depicting input torque variations for a triplex pump based upon pump input shaft rotational degrees.

In Block 1 of FIG. 1 and graphically depicted in FIG. 2, the output characteristic of volumetric displacement would directly relate to the input torque variations above 10 and below 12 the comparative mean 14. The processor identifies the output discharge characteristics such as the number of plungers, pistons in a piston pump, or vane/gear in a rotary pump. The processor also utilizes a comparative mean where, the comparative mean is representative of the basic torque requirement of the pump input shaft rated at a specific output pressure of the pump. A pulsation pattern 16 would be repeated at the same rate per revolution as the number of the pump's volumetric displacement cavities. As illustrated in FIG. 2, a triplex positive displacement pump would repeat a pulsation pattern 16 every 120 degree rotation of the pump input shaft. These torque variations above 10 and below 12 the mean 14 are calculated and recorded for Block 1 of FIG. 1.

For other pumps such as a quintaplex plunger pump, which incorporates five plungers, a pulsation pattern would be produced five times per revolution of the pump input shaft, repeating every 72 degrees if the output pressure is to remain constant and for a rotary vane pump with nine vanes selected; the pulsation pattern would repeat every 40 degree rotation of the pump input shaft if the output pressure is to remain constant.

Figure 3:
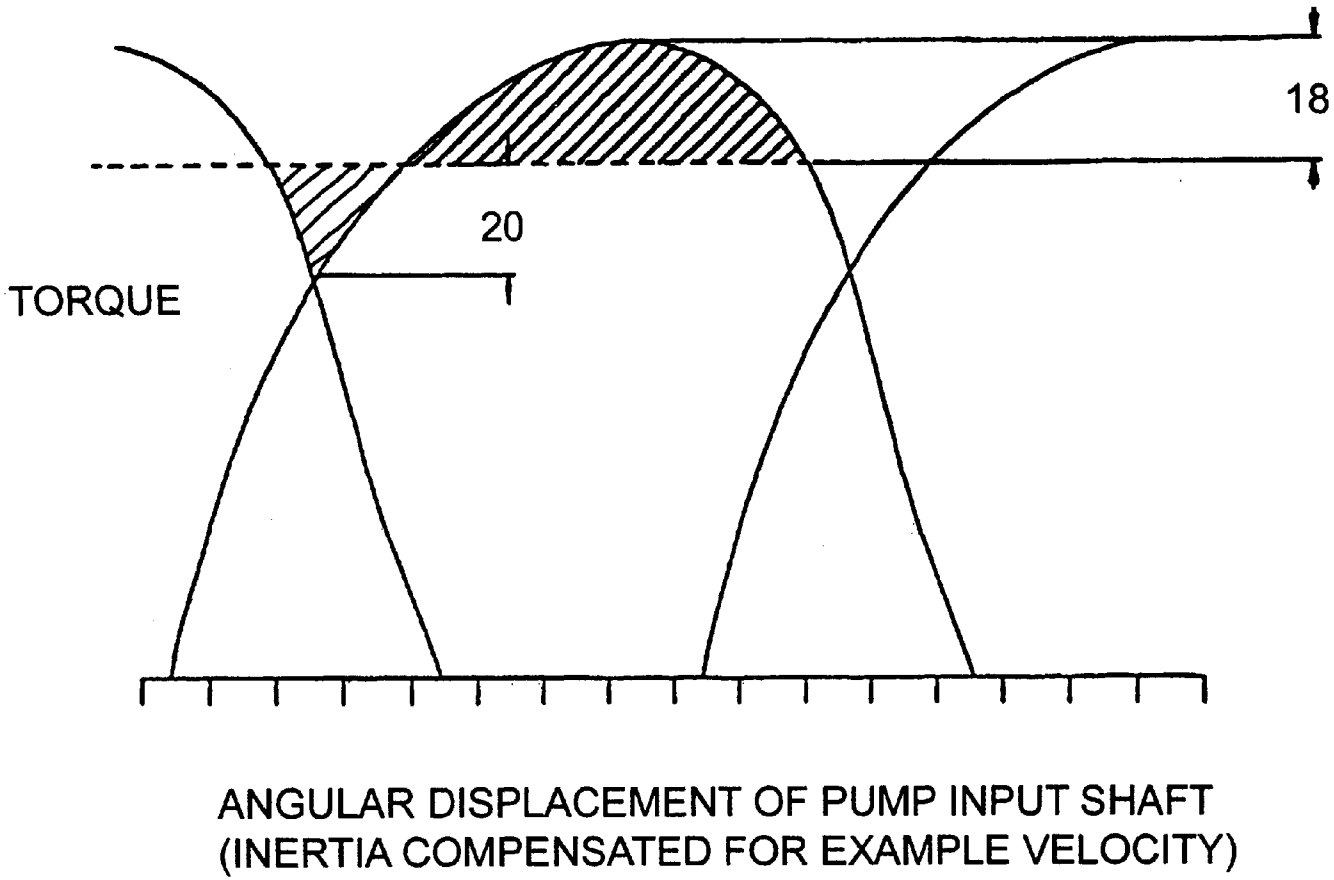
FIG. 3 is a graph depicting a percentile summation of input torque variation compared to angular displacement of input shaft of a triplex pump.

In Block 2 of FIG. 1 and depicted graphically in FIG. 3, the torque profile versus displacement angle of the targeted pumping system is the summation of the torque requirement for each volumetric displacement component, depicting a percentage above mean 18 and the percentage below mean 20.

In Block 3 of FIG. 1, the magnitude of input torque variation to power pumps is determined by the processor, where the magnitude of torque variation is the number of volumetric displacement cavities activated in one revolution and the relationship "Q". The calculation "Q" is the linear distance "L" between the plunger/piston pivot point and the throw pivot point multiplied by the throw radius "R"; "Q=LR". FIG. 4 in table form, depicts the percentile variations of input torque above and below the mean for triplex pumps with various "Q".

Figure 5:
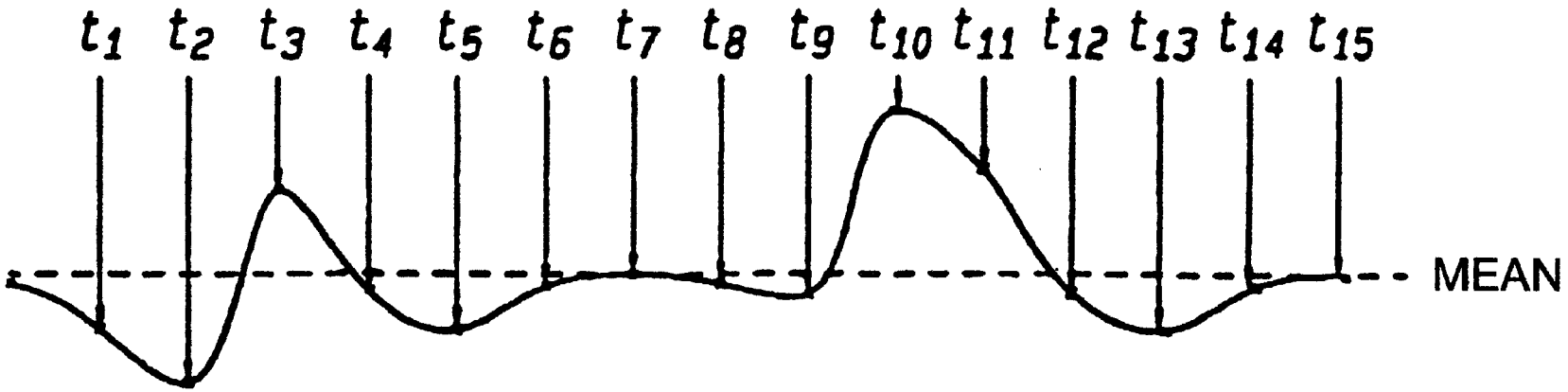
FIG. 5 is a graph depicting a plotting of geometric distance variation points based upon the total torque variation for a triplex pump.

FIG. 5 graphically depicts the total torque variation to show a torque profile for a triplex pump (three volumetric displacements per revolution) with a "Q" at 4:1 with variations shown above and below the mean. The mean is representative of the basic rms (root mean squared) torque requirement of the pump input shaft rated at a specific output pressure of the pump versus the angular displacement angle of the pump crank shaft. The relationship of "Q" and the effect it has on torque variation would also apply to rotary pumps. A plotted geometric distance variation using t1–t15 as plotting points is then imposed on the torque profile.

Figure 6:
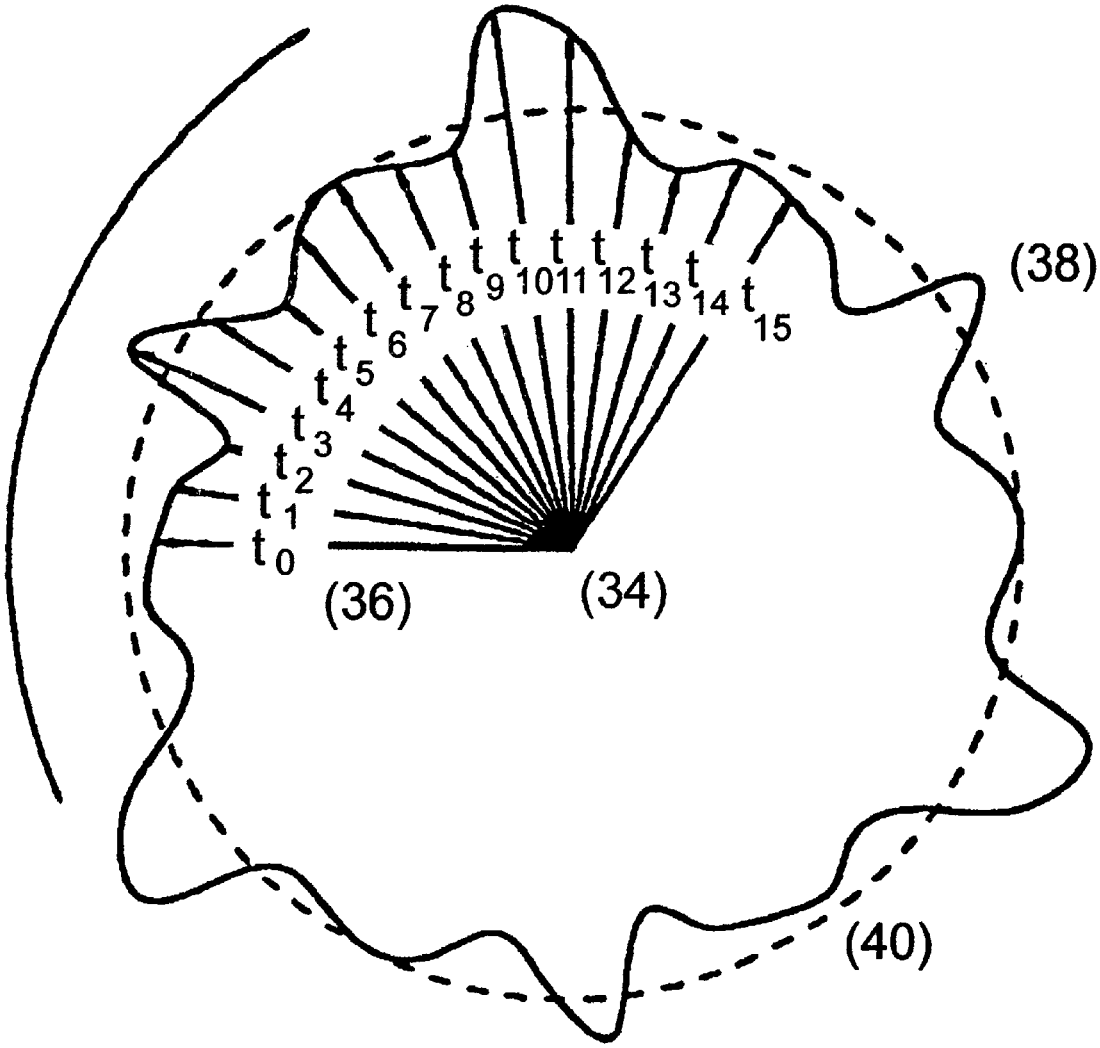
FIG. 6 is a polar map depicting the torque profile versus angular displacement of a pump input shaft.

In Block 4 of FIG. 1 and graphically depicted in FIG. 6, a pump polar map is determined based on the torque profile and the input shaft angular displacement of the pump. The center 34 of the polar map is to represent zero torque. The incremental lines 36 depicted orbitally are the angular displacement of the targeted pump's input shaft. The plotted pump torque variation curve 38 that occurs above and below the mean 40 is to be considered a geometric percentage of the summation of the torque requirement of each of the volumetric displacement components of the targeted pump.

The distance of each point plotted on the polar map's center from the base diameter's center is to be located at the geometric distance variation (over or under) of the base radii percentile established from torque versus the pump input shaft displacement angle (t1 thru t15). The geometric distance variations are the plotting points determined in FIG. 5. The torque versus angular displacement profile of the pump system selected is to become the reference polar guide for the comparitor algorithm in the processor in Block 5 of FIG. 1. The reference polar guide determined by the processor in Blocks 1–5 can also be determined externally from the processor and then input into the processor.

Blocks 6–10 of FIG. 1 are the operating steps from electronic attenuation of torque profile to providing constant output pressure at the pump wherein Block 6 indicates a transmission of angular displacement of the input shaft of a pump in operation. A pulse transmitter mounted on the input shaft relays to a counter, which is part of the processor, the angular position of the pump drive.

In Block 7 of FIG. 1, an electronic processor gathers this output shaft orientation feedback information, and processes the angular displacement data. The processor then attenuates from the peak requirement of the pump, the output torque of the drive compared to the predetermined reference polar map of Block 5. A corresponding torque command value is then selected.

In Block 8 of FIG. 1, other inputs of system readings such as system inertia, parasitic leads, off throttle friction, response time of the pump, motor inductive reactance, application characteristics of the pump, regenerative energy during deceleration of the pump, and translation speed can be selectively factored into the processor algorithm for changes in process control.

In Block 9 of FIG. 1, based upon the inputs of Blocks 7 and 8, the processor of the electronic drive signals the motor controller to apply the correct amperage, voltage, and frequency to the motor which then provides the correct torque according to the angular displacement of the pump input shaft.

In Block 10 of FIG. 1, the resultant signal to the motor controller and motor will drive the pumping system to produce constant pressure at the full range of the designed system flow volume regardless of pump radial crankshaft location and the velocity of the fluid pumped.

Block 11 of FIG. 1, depicts the use of this method in future systems where information gathered from pump operation by this method can be used to design more responsive components such as transmissions and electronic drives. More responsive components would decrease the time increments between Blocks 6–10. As response times are decreased, torque output produced for indicated angular displacements will increase in efficiency.

Thus, the aforementioned objects and advantages are most effectively attained. Although preferred embodiments of the present invention have been disclosed and described in detail herein, it should be understood that this invention is in no sense limited thereby and its scope is to be determined by that of the appended claims.

I claim:

1. A method for electronically attenuating a torque profile in order to control output of a positive displacement pump, the method comprising the steps of:

providing an electronic drive processor;

determining a reference polar guide of torque profile compared to the angular displacement of the input shaft of said pump whereby said determination is stored in said processor;

measuring an angular position of a pump drive shaft in operation;

inputting said angular position into said processor;

comparing said angular position input with said reference polar guide;

selecting a corresponding torque command value from the comparison of the angular position input with the polar guide;

signaling a motor controller wherein said motor controller regulates the amperage to a motor;

enabling the motor to apply an amount of torque to the pump input shaft; and powering the pump to provide a constant output pressure.

2. The method of claim 1, wherein the determination of said polar guide is by the processor.

3. The method of claim 1 further including the step of transmitting said angular position of the pump drive shaft from a pulse transmitter to said processor.

4. The method of claim 1, wherein said motor controller regulates the voltage supplied to the motor.

5. The method of claim 1, wherein said motor controller regulates the frequency supplied to the motor.

* * * * *